United States Patent [19]

Fletcher

[11] 4,168,672

[45] Sep. 25, 1979

[54] WATERCRAFT THRUST TRANSMITTAL APPARATUS

[76] Inventor: Edwin H. Fletcher, 2801 Sombrero Blvd., Marathon, Fla. 33050

[21] Appl. No.: 825,446

[22] Filed: Aug. 17, 1977

[51] Int. Cl.[2] ..... B63B 21/00

[52] U.S. Cl. ..... 114/248; 114/251

[58] Field of Search ..... 184/1, 5; 293/71 R, 293/48, 49; 114/219, 242, 247–252

[56] References Cited

U.S. PATENT DOCUMENTS

| | | | |
|---|---|---|---|
| 2,874,669 | 2/1959 | Norman | 293/71 R |
| 3,237,964 | 3/1966 | Doyle | 293/71 R |
| 3,512,495 | 5/1970 | Fletcher | 114/248 |
| 3,593,531 | 7/1971 | Saadeh | 114/219 |
| 3,645,225 | 2/1972 | Lunde | 114/246 |
| 3,735,722 | 5/1973 | Hooper | 114/248 |
| 3,756,183 | 9/1973 | Clemence | 114/249 |
| 3,922,993 | 12/1975 | Bludworth | 114/248 |
| 3,954,078 | 5/1976 | Garcia | 114/249 |
| 3,994,367 | 11/1976 | Christ | 184/5 |
| 4,041,888 | 8/1977 | Hooper | 114/248 |

*Primary Examiner*—Trygve M. Blix
*Assistant Examiner*—D. W. Keen
*Attorney, Agent, or Firm*—George H. Baldwin; Arthur G. Yeager

[57] ABSTRACT

An apparatus for the transmittal of thrust from a powered watercraft having a ship-shaped bow to a powerless cargo-carrying watercraft having a bifurcated stern and a recessed well defined thereby may be fabricated from an elongated thrust transmitting apparatus horizontally mounted to the bow of the powered watercraft, complementary retaining apparatus mounted to the powerless watercraft within the recessed well and adjustable coupling apparatus mounted between the two watercraft in the proximity of the thrust transmitting apparatus and the complementary retaining apparatus for holding the thrust transmitting in retaining contact with the complementary retaining apparatus such that a horizontal pivotal axis, substantially transverse to the length of the two watercrafts is formed between the thrust transmitting apparatus and the complementary retaining apparatus.

54 Claims, 12 Drawing Figures

Fig. 1
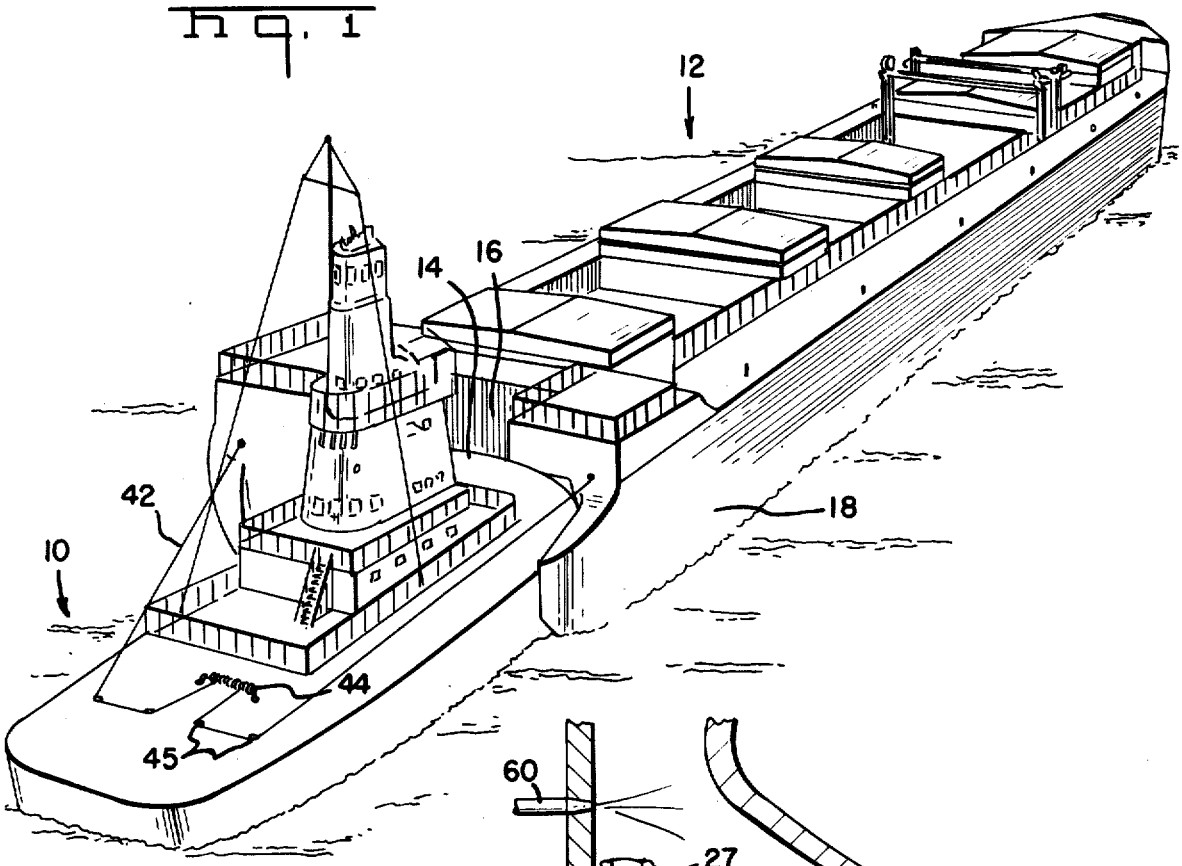
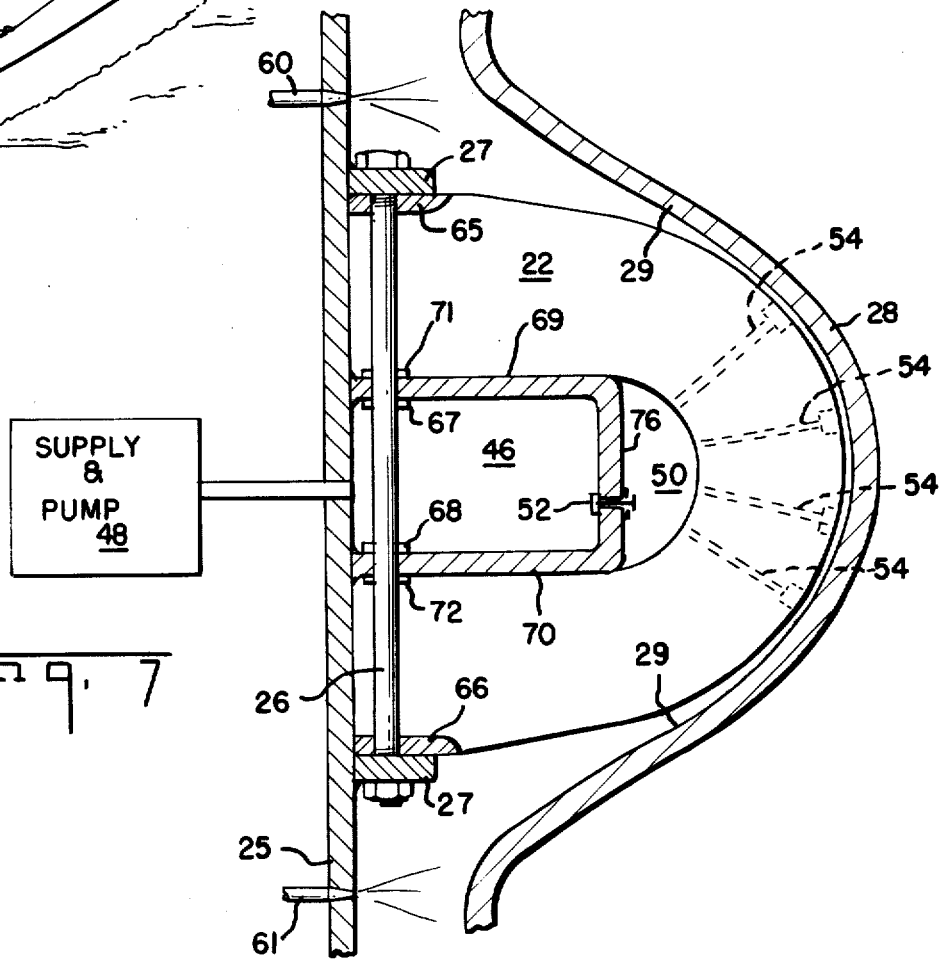
Fig. 7

10
10

36
40
41
39
24
28
39
35
33
40
34
34

36
40
33
35
34

WATERCRAFT THRUST TRANSMITTAL APPARATUS

BACKGROUND OF THE INVENTION

This invention relates generally to means for interconnecting water-borne vehicles and specifically to an apparatus for providing a thrust transmittal connection between a powered watercraft, such as a tug, and a powerless cargo-carrying watercraft, such as a barge.

It has long been known to transport cargo by loading the cargo onto a barge and thereafter utilize a tug boat to essentially push the loaded barge to the cargo destination. Although such a method of cargo transportation may be accomplished with relative ease using a tug and a barge which are totally uncoupled, the safety of such a method, as well as its efficiency in rough water, is less than desirable. For this reason various apparatuses have been devised which provide a secure connection between tug and barge during the transportation process.

U.S. Pat. Nos. 2,715,380 to Archer; 3,035,536 to Archer; 3,370,564 to Archer et al; 3,485,200 to Iozza; 3,512,495 to Fletcher; 3,910,219 to Ono et al; 3,988,999 to Janssen; 3,993,014 to Hooper, et al; 4,013,032 to Bludworth; and 4,031,843 to Colin all disclose systems for bow-to-stern coupling of a tug to a barge.

U.S. Pat. Nos. 2,684,653 to Dyer; 3,109,406 to Stockdale; 3,483,842 to Ken Ohcho; 3,486,476 to Breit, Jr.; 3,605,675 to Clemence, Jr.; 3,613,628 to Garcia; 3,756,183 to Clemence, Jr.; 4,000,714 to Colin; and 4,023,519 to Harms disclose the use of a line or cable extending from the bow of the tub to the stern of the barge for, at least in part, aiding or maintaining the bow-to-stern coupling between the two watercraft.

U.S. Pat. Nos. 2,870,734 to Armstrong, et al; 2,984,202 to Lunde; 3,645,225 to Lunde; 3,735,722 to Hooper, et al; 3,446,173 to Ken Ohcho et al; 3,461,829 to Mosvold; 3,802,375 to Janssen; and 3,804,052 to Lucht each disclose in addition to the bow-to-stern coupling, the use of lines or cables extending from the stern of the tug to the stern of the barge for, at lease in part, maintaining the two watercraft in alignment.

Despite the variety of methods of coupling such watercraft, there remains heretofore unfulfilled need for a thrust transmittal apparatus which will provide the required amount of coupling stability while, at the same time, avoiding the necessity of making a semi-positive connection mounted integrally between the two watercraft such as, for example, is made in my prior U.S. Pat. No. 3,512,495.

SUMMARY

It has now been discovered that safety considerations through a quick disconnect, and other connection and operating difficulties encountered with prior art devices may be avoided by use of an apparatus for the transmittal of thrust between the bow of a tug and the bifurcated stern of a barge which includes an elongated thrust transmitting means horizontally mounted to the bow of the tug, complementary retaining means mounted to the bifurcated stern of the barge, and adjustable coupling means mounted between the tub and barge in the proximity of the thrust transmitting means and the complementary retaining means, which adjustable coupling means serves to hold the two other means in retaining contact such that a horizontal pivotal axis transverse to the length of the tug and barge is formed. In addition, the apparatus may include cable means connecting the tug to the barge for maintaining longitudinal alignment between the two, and a number of resilient bumpers mounted to the bow of the tug to absorb inadvertent collision shock between the bow and the bifurcated barge stern.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

FIG. 3 is a side elevational view, partly in section, similar to that of FIG. 2 with the barge fully loaded;

FIG. 5 is an enlarged plan view of the coupling means shown in FIG. 4;

DESCRIPTION OF THE PREFERRED EMBODIMENT

Figure 1:
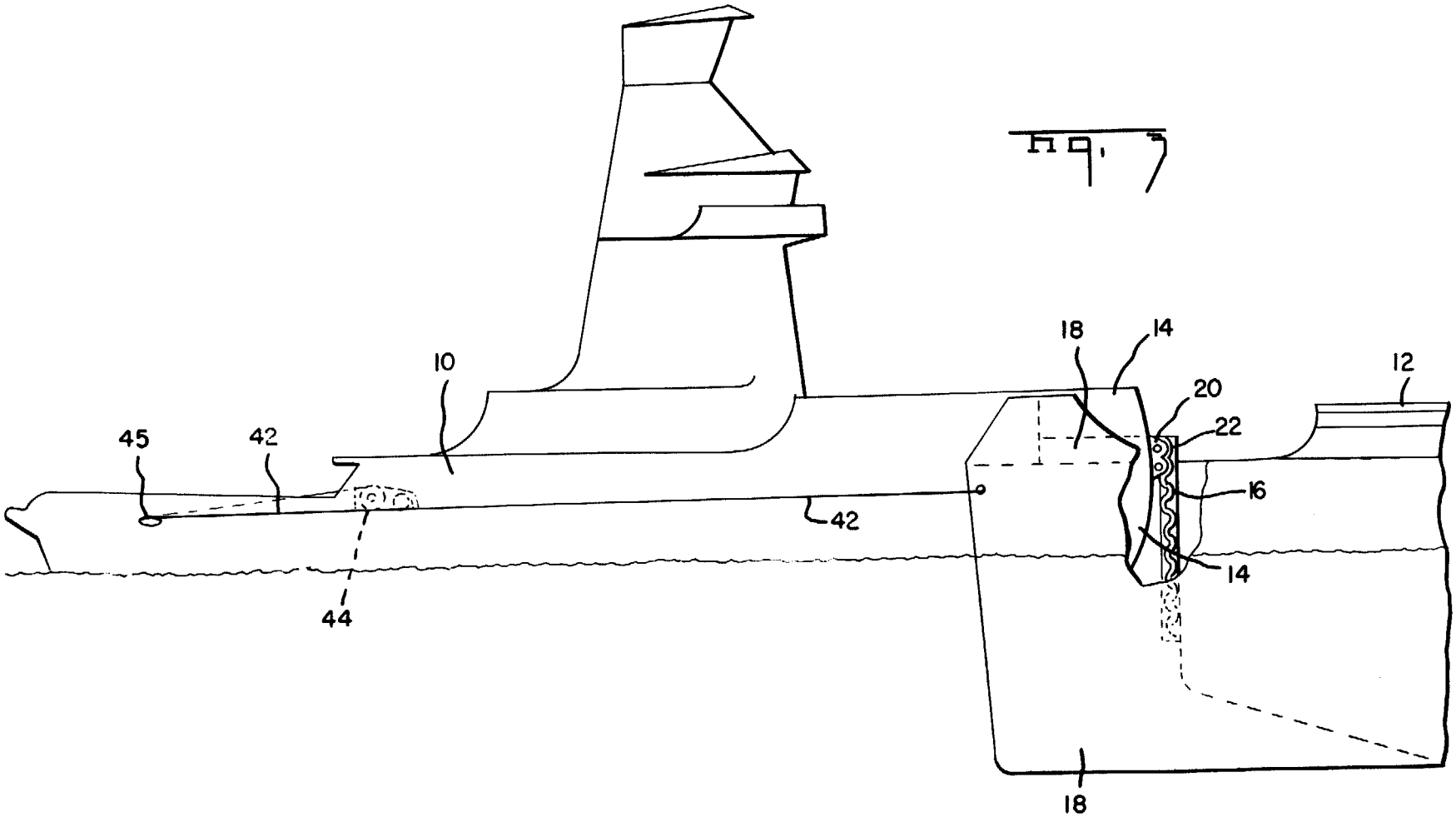
FIG. 1 is a perspective view of a tug and a barge having a shallow recessed well coupled for thrust transmittal by one embodiment of this invention.

Referring to FIG. 1 there is seen a powered watercraft, or tug, 10, and a powerless cargo-carrying watercraft, or barge, 12 connected together with tug bow 14 inserted in shallow recessed well 16 of bifurcated stern 18 of barge 12 such that the tug and barge are aligned along their respective longitudinal axes.

Figure 2:
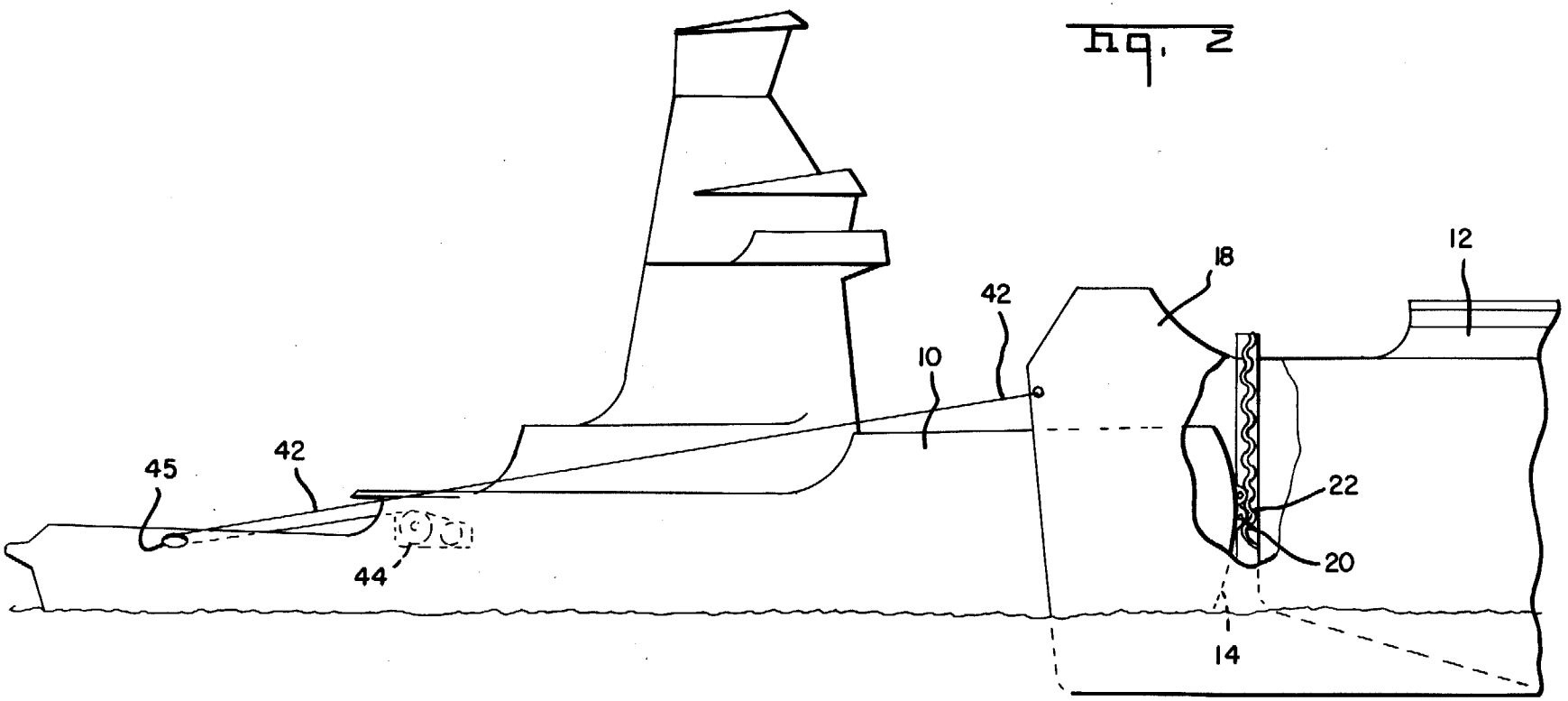
FIG. 2 is a side elevational view, partly in section, of the tug and barge shown in FIG. 1 with the barge in ballast.
Figure 4:
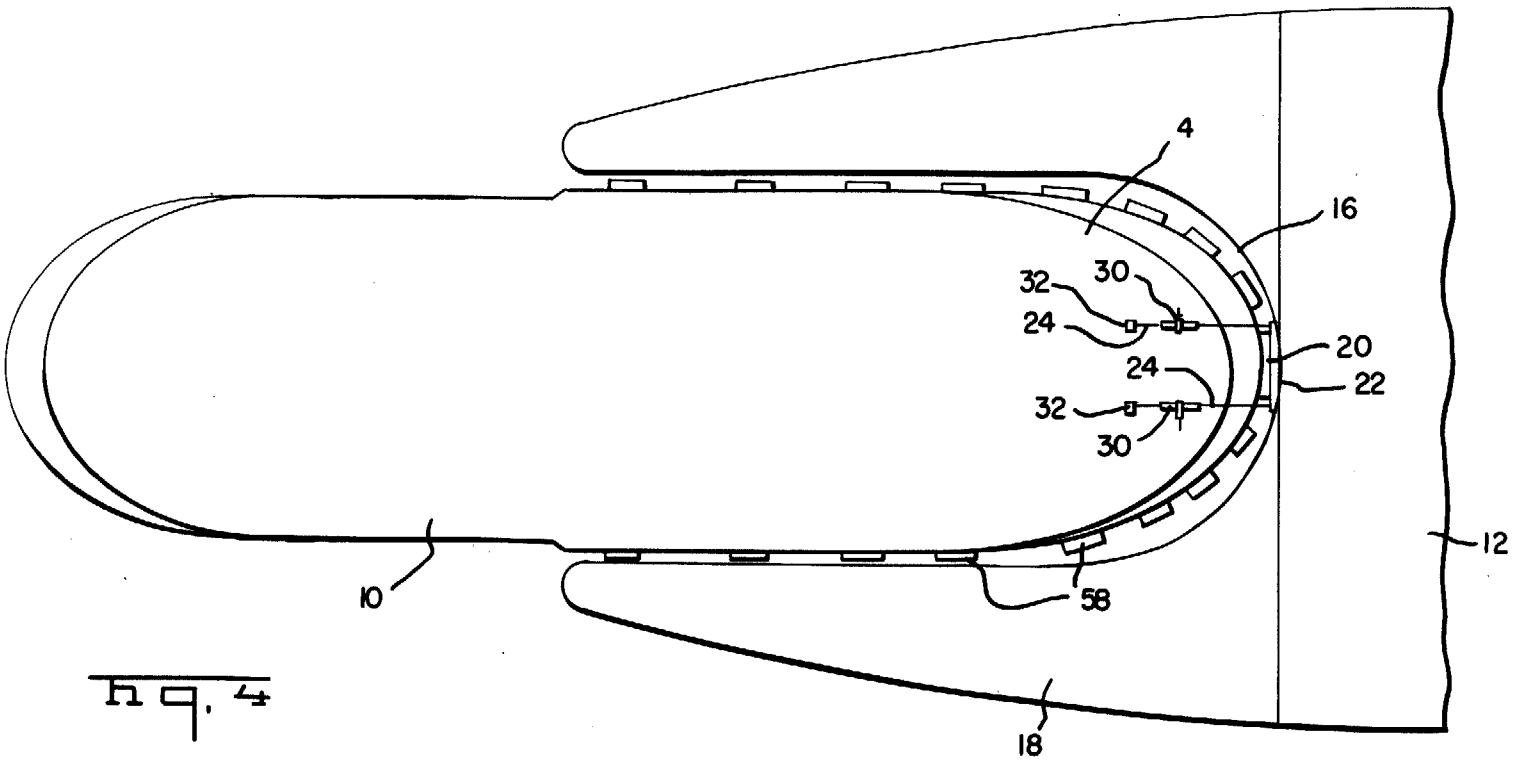
FIG. 4 is a plan view of the tug and a barge having a deep recessed well and a pair of coupling means in accord with a second embodiment of the invention.

As may be more clearly seen in FIGS. 2, 3 and 4, the connection between tug 10 and barge 12 is effected by an elongated, horizontal thrust transmitting means 20 which is rigidly mounted to bow 14 transversely to the longitudinal axis of the tug, a complementary retaining means 22 which is horizontally mounted to barge 12 centrally of recessed well 16 and transversely to the longitudinal axis of the barge 12, and adjustable coupling means 24 for forcibly holding the thrust transmitting means 20 in contact with retaining means 22.

Figure 7:
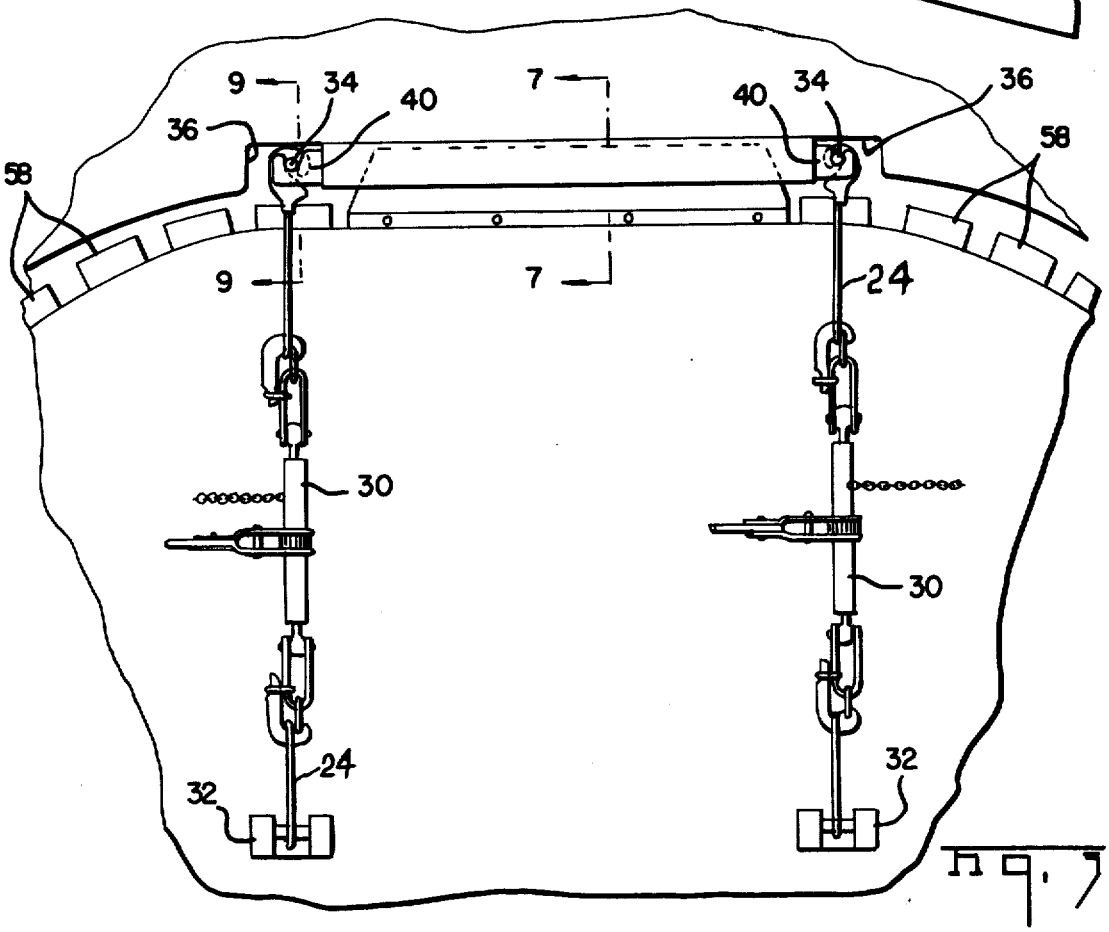
FIG. 7 is an enlarged vertical section of the thrust transmitting means and the complementary retaining means in operative engagement on an enlarged scale taken along line 7—7 of FIG. 5.
Figure 8:
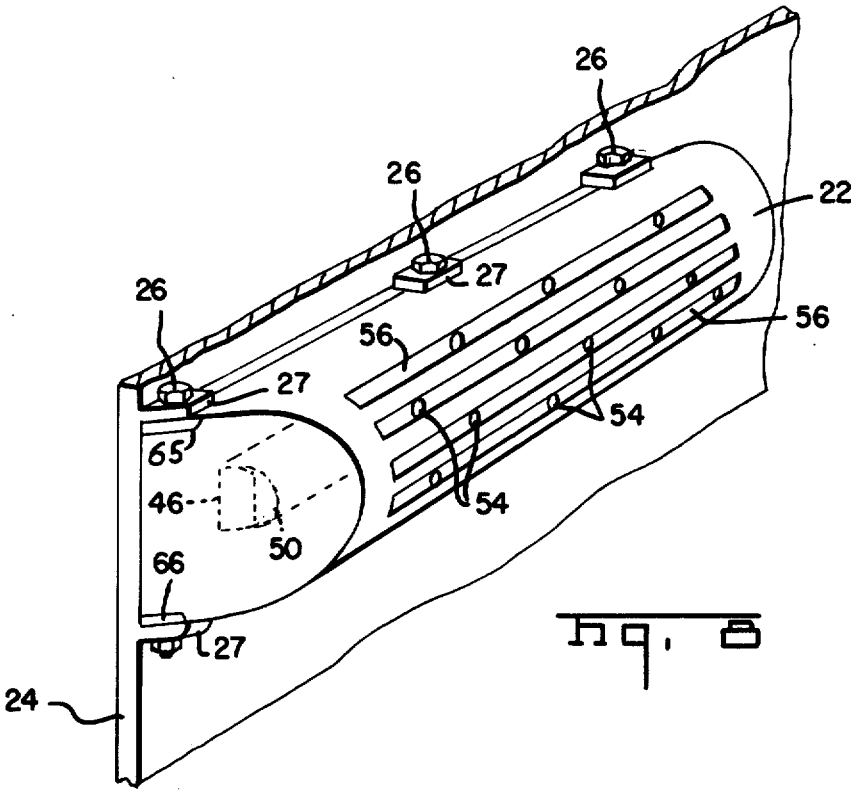
FIG. 8 is a perspective view of a preferred thrust transmittal means used in this invention.

In one embodiment shown in FIGS. 2, 3 and 4, thrust transmitting means 20, as shown in FIGS. 7 and 8, comprises a semi-cylindrical resilient bumper 22 which is rigidly mounted to a bow plate 25 by any suitable mounting means such as nut and bolt mounts 26 extending through a pair of spaced flanges 27 extending outwardly of and integrally to bow plate 25. Bow plate 25 is, in turn rigidly mounted to bow 14 by any conventional means, now shown, while only one bumper 22 is necessary to effectively practice the invention, it is preferred to use two or more as explained hereinbelow.

Bonded to the bumper 22 are a pair of bars 65 and 66 which may extend throughout the length of the bumper with the nut and bolt mounts 26 passing through such bars, as well as the bumper resilient material. The lubricant sump 46, hereinafter more fully described, has a pair of bearings 67 and 68 mounted in walls 69 and 70, defining a portion of the sump 46, through which the bolts extend in the manner depicted. Numerals 71 and 72 are illustrative of washers which may be bonded to bumper 22, as is known in the art. The bumper 22 has a hollow 75 therein which fits snugly on walls 69 and 70 of sump 46 while reservoir or cavity 50 is defined between end wall 76 of sump 46 and the inner surface 77 defining hollow 75.

Figure 6:
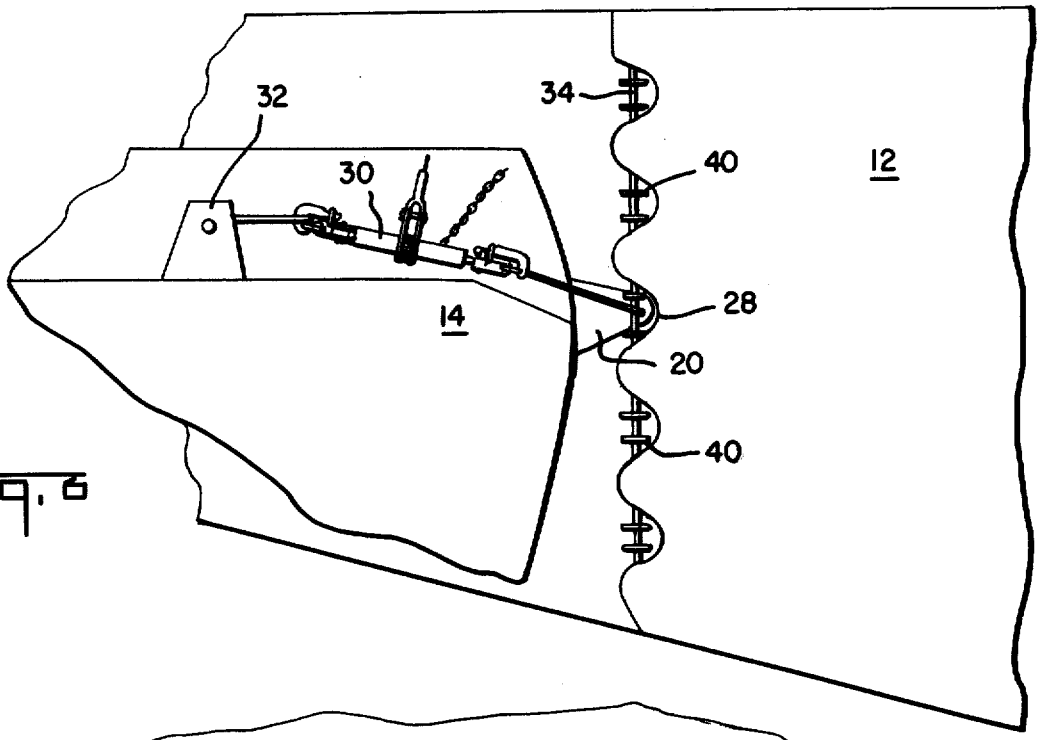
FIG. 6 is a side elevational view of the apparatus shown in FIG. 5.

Referring to FIGS. 5, 6 and 7, the complementary retaining means 22 is seen to comprise a rounded elongated grooved member 28 rigidly mounted to recessed wall 16 of barge 12 such that the bumper 22 is accomodated therein and restrained from vertical movement therein by the side walls 29 of grooved member 28. As with bumper 22, only grooved member 28 is necessary to practice the invention, however, in order for bumper 22 to be able to mate with groove 28 under a variety of barge loading weights, it is preferred that a retaining means 22 comprise a plurality of rounded grooves 28 mounted in vertically superposed array thus also reduce barge hull structural stresses. Furthermore, while it is contemplated that this plurality of superposed grooves could be fabricated as distinct units, the optimum embodiment of the invention utilizes a unitary corrugated sheet of plate as shown in FIG. 6. By so doing, not only is construction of the apparatus facilitated, but also the degree of undulation of the grooves and their depth may be chosen such that, in the event the bumper comes out of the groove in heavy seas, the bumper will tend to slide over the outwardly extending inter-groove peak and back into one of the other grooves. Once again in the optimum embodiment, the number of grooves is preselected such that the uppermost groove is aligned with semi-cylindrical bumper 20 when the barge is fully loaded, as in FIG. 3, and that the lower most groove is aligned with bumper 20 when the barge is in ballast, as in FIG. 2.

As will be apparent to those skilled in the art, it is not necessary that the convex semi-cylindrical bumper be mounted to the tug and that the concave groove be mounted to the barge. Reversing the combinations will not result in loss of funcitonality and thus the tug-mounted thrust transmitting means may comprise one, two or three concave grooves and the barge-mounted complementary retaining means may comprise a plurality of parallel vertically superposed convex bumpers. In addition, an embodiment which has one or two grooves mounted to the recessed well of the barge in combination with a number of bumpers mounted to the bow of the tug is also contemplated as being in accord with aspects of this invention.

The final element in the apparatus in its broadest functional form is adjustable coupling means for forcibly holding which is mounted to, and between, the tug and barge in order to apply sufficient force between the two watercraft to maintain bumper 20 in grooved member 28. Although the use of either of two embodiments of such means is contemplated within the broadest embodiment of the invention, the preferred embodiment of the invention for use when the barge has a deeply recessed well utilizes two coupling means 24 as shown in FIGS. 4 and 5. Adjustability of length of the coupling means 24 for holding is a critical factor since the method of use of the apparatus comprises bringing the bumper 20 into the proximity of groove 28 followed by attaching the means 24 for holding between the two watercraft and subsequently decreasing the length of such means in order to apply sufficient tension to hold the bumper in the groove.

In addition to having an adjustable length, the preferred embodiment of the coupling means 24 is equipped with a constant tension device 30, which may be of any suitable construction i.e. spring loaded, hydraulic, etc. This constant tension device 30 enables the coupling to withstand the jolting effect of moderate or heavy seas that will be absorbed by the constant tension device rather than by subjecting a cable or the like to high variations in strain.

Figures 9, 10:
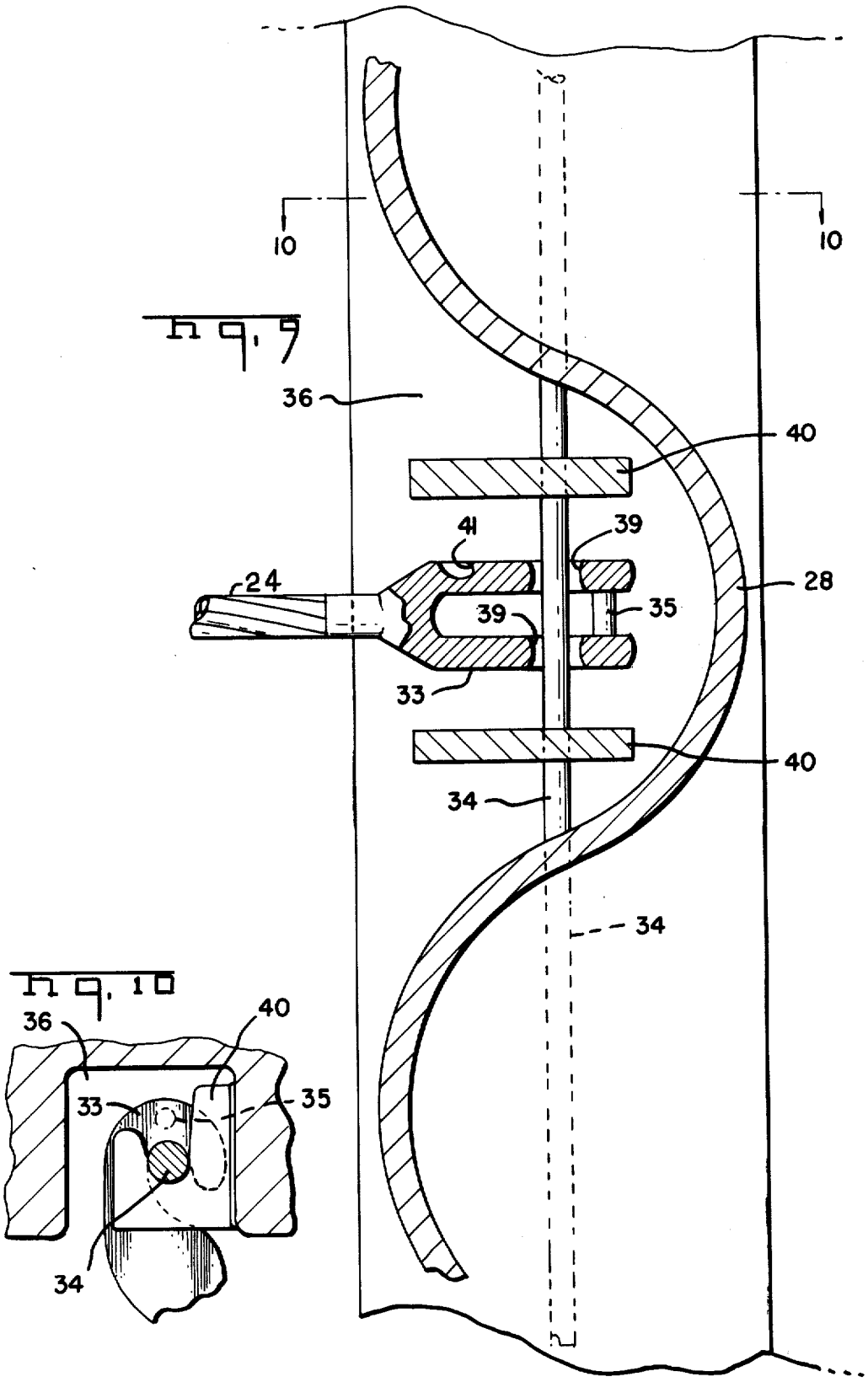
FIG. 9 is a longitudinal vertical section of means for forceably holding the thrust transmitting means in contact with the retaining means taken along line 9—9 of FIG. 5.
FIG. 10 is a reduced horizontal section along the line 10—10 of FIG. 9.

As shown most clearly in FIGS. 5, 6, 9, and 10, the means 24 for holding is mounted, at one end thereof, to a rigid mounting strut 32 or the like on the deck of tug bow 14. The other end 33 of coupling means 30 is mounted to the stern of barge 12 at a point closely coinciding with that of the groove 28 into which bumper 20 is to be inserted. While such mounting may be accomplished in any suitable fashion, the preferred stern mount includes one or more vertical shafts or cables 34 which are rigidly mounted to the recessed well of the barge stern. Each mounting cable 34 is recessed into a vertical channel 36 located immediately outwardly adjacent the ends of the retaining grooves 28. By recessing the mounting shafts 34 into vertical channels 36, the potential for a damaging collision between bow 14 and shaft 34 is eliminated. A plurality of stops 40 are attached to the channels 36 and are positioned so as to prevent the end 33 of the holding means 24 from being vertically displaced along the length of the mounting shaft and also to provide greater rigidity to cable 34. Referring to FIGS. 9 and 10 it is seen that coupling means 24 is preferably releasably attached to cable 34 by the use of a bifurcated hook end 33 which has a hook brace 35 to improve bifurcation rigidity and which has relieved interior edges 39 to avoid gauging of the cable 34 by hook end 33. A hook end engaging indentation 41 may be provided to act as a seat for a grappling hook or the like which could be used to maneuver the hook end 33 into position. Thus by attaching the holding means 24 to the mounting cable 34 at a point thereon adjacent the grooved member 28 into which the bumper 20 is to be inserted, the holding means 24 will be restricted to a point of attachment adjacent to the desired groove and tensioning of the holding means 24 will draw the bumper 20 into a tight fitting engagement in the desired groove.

Figure 12:
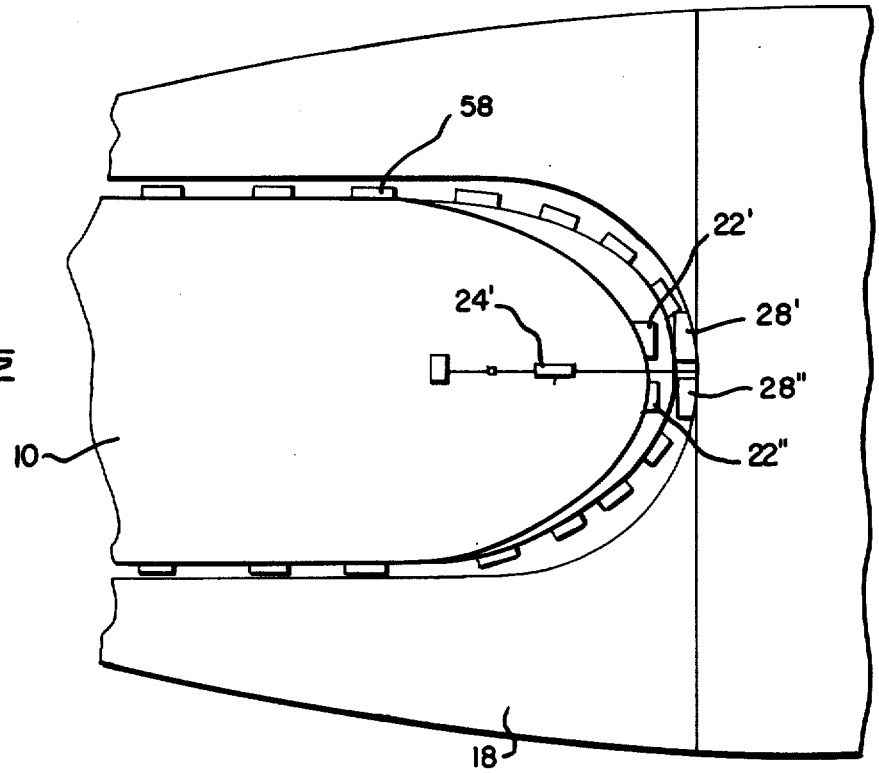
FIG. 12 is a plan view similar to FIG. 4 but showing a single coupling means.

Although FIG. 6 shows the holding means 24 at a downwardly inclined angle, it is contemplated that a horizontal, or even upwardly inclined orientation will function effectively. In addition, while the preferred thrust transmittal apparatus has been described as comprising a single vertical row of retaining grooves, a single thrust transmitting bumper and two holding means, the apparatus in accord with this invention may comprise a centrally vertically split bumper 22' and 22'', two parallel vertical rows of retaining grooved members 28' and 28'' and a single holding means 24' which is substantially aligned with the longitudinal axes of tug and barge and generally bisects the gap between the two bumpers and rows of members to connect tug to barge, as shown in FIG. 12.

As an alternative adjustable coupling means for holding which is preferred for use with a barge having a shallow recessed well, cables, preferably including constant tension devices, may be provided which releasably mount to the stern of the barge and which extend rearwardly from the barge stern to a winch mounted to the deck of the aft portion of the tug may be utilized. With such an embodiment, these cables, such as those shown at 42 of FIG. 1, may be wrapped about the axle of the winch and the winch actuated to forcibly hold the bumper 20 against the retaining groove member 28. This embodiment, in addition, will cause the two vessels to be maintained in longitudinal alignment as described hereinbelow. For this reason such a cable and winch system may be used in addition, to as well as in place of, coupling cables 24.

The three elements of the apparatus, i.e. the thrust transmitting bumper 20, the retaining groove 28 and the adjustable holding means 24 comprise the invention in its most elementary functional form. In addition to these three, however, several additional structures may be added which increase the efficiency and/or the safety of the system.

The first such additional element is a means for maintaining longitudinal alignment such as aligning cables 42 of FIGS. 1 and 3. As will be evident to those skilled in the art, the longitudinal planes of both tug and barge should be maintained as close in alignment as possible in order that the thrust transmittal from tug to barge be accomplished with maximum efficiency. To a certain extent the depth of the recessed well and the distance along the sides of the tug to which the bifurcated stern of the barge extends will determine the longitudinal stability of the two watercraft particularly by including resilient fenders 58 therein as shown in FIGS 4, 5 and 8. For instance, a barge having a deeply recessed well such as that shown in FIGS. 1, 2 and 3. Thus while the tub-barge assembly shown in FIG. 4 may function efficiently in the absence of alignment cables 42, those assemblies shown in FIGS. 1, 2 and 3 may well require the additional longitudinal stabilization provided by a pair of alignment cables 42. A suitably powered winch 44 which is rigidly secured to the deck of the tug, preferably towards the stern end of the tug. A pair of cables 42 are then strung between a second end which is attached to cable mounts 45 on the barge and a first end which is adapted to be wound about the drum of the winch and wound thereabout to increase the cable tension. By so doing, and by concurrently adjusting the lengths of the two cables, the tension on the cables may be used to maintain the tug and barge in longitudinal alignment. In the optimum embodiment a constant tension apparatus, not shown, may make up part of the length of each cable in order to act as a shock absorber in moderate or heavy seas.

To increase the efficiency of the apparatus, and to inhibit wear a lubricant supply is provided for the thrust coupling. The preferred construction of the thrust transmitting bumper 22 is fabricated from a resilient material and the retaining grooved member 28 is fabricated from a rigid material, such as steel. In order to provide the contacting faces of these two elements with increased longevity, an abrasion-reducing lubricant is provided therebetween to coat the mating surfaces thereof. As shown in FIG. 7, a lubricant sump 46 is provided interiorly of each bumper 22, a remotely actuatable supply and pump 48 which is mounted rearwardly of bumper 22 and in communication with sump 46, a lubricant cavity 50 interiorly of bumper 22 and formed by the outer wall of the lubricant sump 46, a unit-directional valve 52 mounted in end wall 76 which allows lubricant to flow only from sump 46 into reservoir or cavity 50, and series of lubricant or conduits passageways 54 leading from lubricant cavity 50 to the contact surface of bumper 22. In addition, the preferred embodiment of the bumper 22 includes a plurality of horizontal lubricant channels 56, as is more clearly shown in FIG. 8, such that lubricant passing outwardly of from the lubricant passageways 54 may be distributed and captured along lubricant channels 56 and flow thereover substantially over the entire rounded contact face of bumper 20. As shown in FIG. 8, channels 45 terminate short of the ends of bumper 20 to avoid excessive loss of the lubricant, in a manner as would be apparent to those skilled in the art. As will also be apparent, the resilient nature of the bumper 20 taken in combination with the lubricant cavity 50 and the uni-directional valve 52 will result in a self-pumping action for transferring lubricant from cavity 50 to the surface of bumper 20 during periods of use due to the deformation pressures which are applied to bumper 20 by the varying force of the tug-barge pushing operation.

Figure 11:
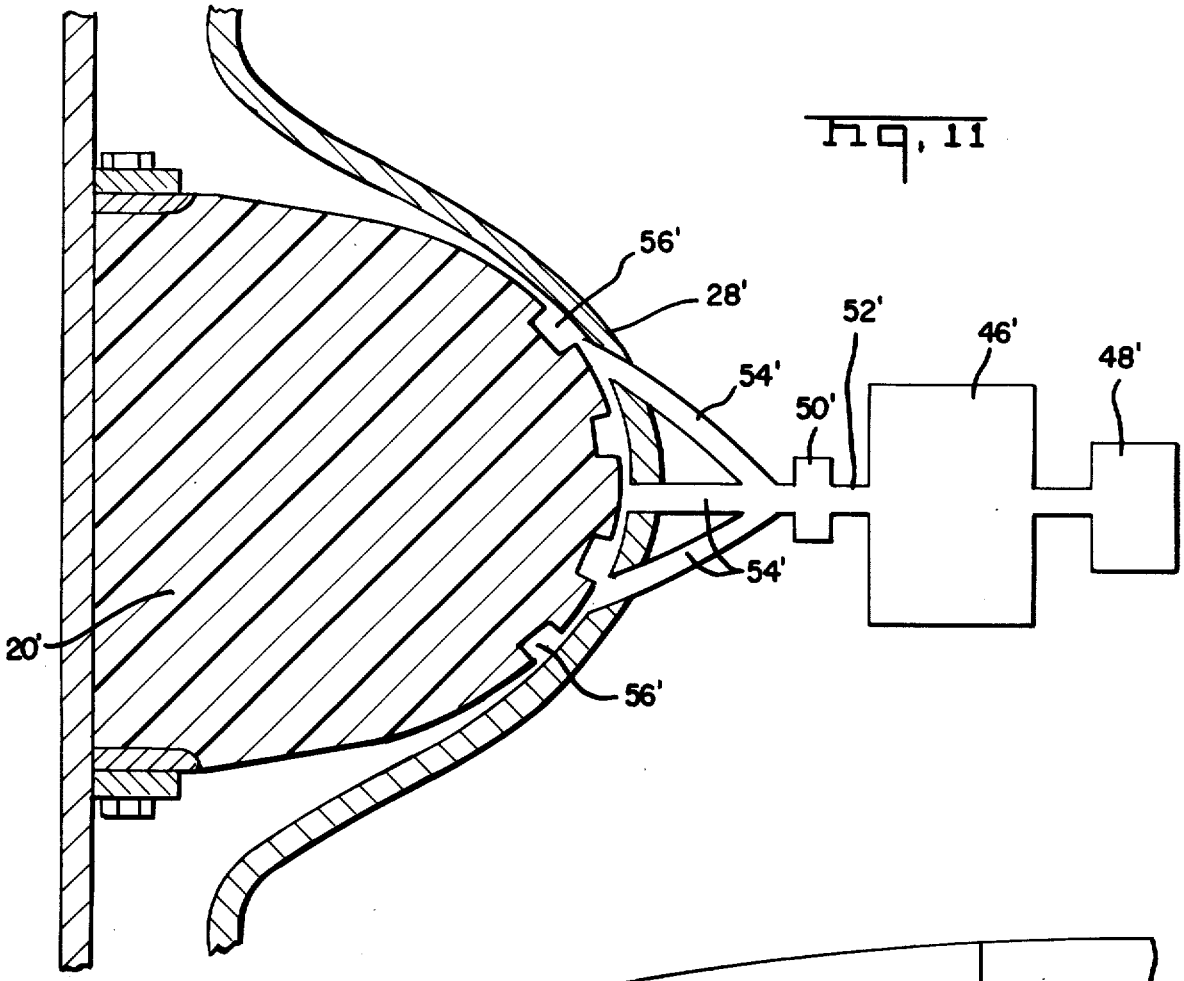
FIG. 11 is a horizontal sectional view similar to FIG. 7 but showing lubrication from the barge.

In another embodiment, shown in FIG. 11, lubricant sump 46' and pump 48' may be mounted on the barge 12 forwardly of the retaining grooves 28', and have a plurality of lubricant passageways or conduits 54' communicating from the surface of groove 28' to lubricant cavity 50' which cavity is in uni-directional communication, through check valve 52', with lubricant sump 46'.

In the embodiments of the invention a plurality of resilient fenders 58 are provided which are mounted to the exterior sides of bow 14 of tug 10 in order to cushion any potentially damaging collision between bow 14 and the interior surface of recessed well 16. In the preferred embodiment, each fender 58 is fabricated from a resilient material such as rubber and extend vertically for some distance or may be formed from a plurality of vertically spaced fenders.

The operation of the thrust transmittal apparatus will be evident to those skilled in the art from the following description read in conjunction with the drawings. Tug 10 is maneuvered into position behind barge 12 with the bow 14 of the tug generally in alignment with the recessed well 16 of bifurcated barge stern 18. Tug 10 is then urged forward between the rearwardly projecting bifurcations of stern 18, with the shock of inadvertant collisions between bow 14 and stern 18 being absorbed by bumpers 58. As the depth of insertion is progressively increased thrust transmitting fender 20 will approach and contact one of the plurality of retaining grooves of member 22. Once such close approach or contact is achieved, releasable adjustable length cables 30 are connected to mounting shaft 34 between stops 40 and to the deck mount 32. The tension on cables 30 is then increased to the point that bumper 20 is firmly seated in a groove of member 22. If the particular configuration of tug 10 and barge 12 so requires, alignment cables 42 are mounted to barge 12, engaged to the drum of winch 44 and the winch actuated to stretch the cables 42 taut to thereby maintain longitudinal alignment between tug and barge.

Once the two watercraft have been connected as described, pump 48 can be actuated to force a supply of lubricant from sump 46 through valve 52 to lubricant chamber 50 and through lubricant passageways 54 to the contact interface of bumper and groove. As the rounded contact faces move against each other, lubricant will be distributed therebetween reducing abrasion of the surfaces. At the intended destination of the thusly coupled watercraft, the connection process described above is reversed and the tug freed to perform another operation.

Alternativey, a separate supply of salt or fresh water can be sprayed through nozzle means in the form of a plurality of spaced nozzles 60 and 61 above and below bumper 22, as illustrated in FIG. 7, for example. This water sprayed on the pivoting coupling will not only function as a lubricant but will also be a coolant since not only is friction decreased but the parts are cooled thereby.

As will be evident to those skilled in the art, the transmittal apparatus hereinabove described is capable of accomplishing a secure coupling relationship between tug and barge which allows a significant amount of flexibility in the event of moderate to heavy seas.

While the invention has been described with respect to certain specific embodiments, it will be appeciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. An apparatus for thrust transmittal from a powered watercraft, said powered watercraft having a forward section terminated by a bow and having an aft section terminated by a stern, to a powerless cargo-carrying watercraft having an aft section terminated by a stern bifurcated so as to form a recessed well therein comprising:

a. a thrust transmitting means having a longitudinal axis disposed horizontally and substantially perpendicular to the longitudinal axis of said watercrafts, said thrust transmitting means having an elongated exterior surface extending substantially horizontally, said thrust transmitting means being mounted to said bow of said powered watercraft;

b. a retaining means having an elongated exterior surface complementary with said thrust transmitting means exterior surface and being mounted within said well and to said stern of said powerless cargo-carrying watercraft generally centrally of the sides thereof; and c. adjustable coupling means mounted between said powered watercraft and said powerless cargo-carrying watercraft for forcibly biasing said thrust transmitting means exterior surface into complete surface engagement with said exterior surface of said retaining means; said thrust transmitting means and said retaining means being relatively movable about a horizontal pivotal axis established therebetween which is substantially transverse to said watercraft longitudinal axes.

2. The apparatus as set forth in claim 1 wherein said retaining means comprises a plurality of vertically spaced, superposed retaining means.

3. The apparatus as set forth in claim 2 wherein said plurality of retaining means extend in vertically spaced superposed relation such that one of said thrust transmittal means is generally aligned with one of said plurality of retaining means over the full range of loading conditions of said cargo-carrying watercraft.

4. The apparatus as set forth in claim 1 wherein said thrust transmitting means comprises a plurality of vertically spaced, superposed thrust transmitting means.

5. The apparatus as set forth in claim 1 wherein said retaining means comprises a plurality of vertically spaced, superposed retaining means and wherein said thrust transmitting means comprises a plurality of vertically spaced, superposed thrust transmitting means.

6. The apparatus as set forth in claim 1 wherein said elongated thrust transmitting means is resilient.

7. The apparatus as set forth in claim 6 further comprising a plurality of spaced and generally parallel channels in said exterior surface of said thrust transmittal means and extending therealong and terminating inwardly of the ends thereof.

8. The apparatus as set forth in claim 1 wherein said adjustable means are releasable from both said powered watercraft and said powerless watercraft.

9. An apparatus for thrust transmittal from a powered watercraft, said powered watercraft having a forward section terminated by a bow and having an aft section terminated by a stern, to a powerless cargo-carrying watercraft having an aft section terminated by a stern bifurcated so as to form a recessed well therein comprising:

a. an elongated thrust transmitting means horizontally mounted to said bow of said powered watercraft;

b. complementary retaining means mounted centrally of, and within, said well and to said stern of said powerless cargo-carrying watercraft; and c. adjustable coupling means mounted between said powered watercraft and said powerless cargo-carrying watercraft for forcibly holding said thrust transmitting means in retaining contact with said complementary retaining means;

so constructed and arranged that a horizontal pivotal axis substantially transverse to the length of said two watercraft is established between said watercraft, a lubricant sump mounted to said powerless cargo-carrying watercraft forwardly adjacent said retaining means, a plurality of lubricant passageways communicating between said lubricant sump to the exterior of said retaining means, and uni-directional valve means mounted between said passageways and said lubricant sump for the forward flow of lubricant from said sump to said passageways for preventing reverse lubricant flow.

10. The apparatus as set forth in claim 9 wherein said elongated thrust transmitting means includes a resilient member having grooves extending longitudinally thereof and terminating inwardly of the ends thereof.

11. The apparatus as set forth in claim 9 further comprising a plurality of lubricant channels in the exterior surface of said thrust transmitting means communicating with said lubricant passageways, said grooves extending to points along the length of said thrust transmittal means inwardly adjacent the ends of said thrust transmittal means.

12. An apparatus for thrust transmittal from a powered watercraft, said powered watercraft having a forward section terminated by a bow and having an aft section terminated by a stern, to a powerless cargo-carrying watercraft having an aft section terminated by a stern bifurcated so as to form a recessed well therein comprising:

a. an elongated thrust transmitting means horizontally mounted to said bow of said powered watercraft;

b. complementary retaining means mounted centrally of, and within, said well and to said stern of said powerless cargo-carrying watercraft; and c. adjustable coupling means mounted between said powered watercraft and said powerless cargo-carrying watercraft for forcibly holding said thrust transmitting means in retaining contact with said complementary retaining means;

so constructed and arranged that a horizontal pivotal axis substantially transverse to the length of said two watercraft is established between said watercraft, a lubricant sump mounted to said powered watercraft and rearwardly adjacent said thrust transmitting means, a plurality of lubricant passageways communicating between said lubricant sump and the exterior surface of said thrust transmitting means, a uni-directional valve means mounted between said lubricant passageways and said lubricant sump for the forward flow of lubricant from said sump to said passageways and for preventing reverse lubricant flow.

13. The apparatus as set forth in claim 12 further comprising a plurality of lubricant channels in said exterior surface of said thrust transmittal means communicating with said lubricant passageways, said grooves extending to points along the length of said thrust transmittal means inwardly adjacent the ends of said thrust transmittal means.

14. The apparatus as set forth in claim 1 wherein said releasable adjustable means comprises one adjustable length securing cable means extending substantially in alignment with the aligned longitudinal axes of said watercrafts.

15. The apparatus as set forth in claim 14 wherein said thrust transmitting means is defined by a forwardly extending bumper and having ends terminating on either side of said securing cable means.

16. The apparatus as set forth in claim 1 wherein said releasable adjustable means comprises a pair of adjustable length securing cable means extending substantially in parallel with the aligned longitudinal axes of said watercrafts.

17. The apparatus as set forth in claim 16 wherein said thrust transmitting means is defined by a forwardly extending elongated bumper, said pair of securing cable means extending adjacent to and outwardly of respective ends of said bumper.

18. The apparatus as set forth in claim 17 wherein said thrust transmitting means is defined by a pair of forwardly extending elongated bumpers.

19. The apparatus as set forth in claim 18 wherein said retaining means comprises at least a pair of complemental grooved members for respectively receiving said pair of bumpers.

20. The apparatus as set forth in claim 18 wherein said retaining means comprises at least two vertically spaced sets of a pair of complemental grooved members for respectively receiving said pair of bumpers.

21. The apparatus as set forth in claim 1 wherein said releasable adjustable means comprises a pair of adjustable length securing cables, and a plurality of releasable watercraft-engaging means respectively mounted to each end of each said cables, each said watercraft-engaging means on each said cable being respectively secured to said watercrafts on opposite sides of said thrust transmitting means and said complementary retaining means with the cables interconnecting said watercrafts together.

22. The apparatus as set forth in claim 21 further comprising stabilizing means mounted to and between said stern of said powered watercraft and said stern of said powerless cargo-carrying watercraft for maintaining alignment between said watercrafts.

23. The apparatus as set forth in claim 22 wherein said stabilizing means comprises:

a. a winch mounted to the deck of said powered watercraft rearwardly remote from said thrust transmitting means;

b. a pair of connecting means rigidly mounted to said powerless cargo-carrying watercraft laterally of said retaining means; and c. a pair of elongated cables having a first end engaged by said winch and a second end releasably attached to said connecting means of said powerless cargo-carrying watercraft.

24. The apparatus as set forth in claim 1 wherein each said thrust transmittal means and said retaining means include a plurality of such means arranged in two spaced, vertically parallel rows disposed about the vertical longitudinal plane of each of said watercrafts and wherein said releasable adjustable means comprises an adjustable length securing cable and a pair of releasable watercraft engaging means, one of said watercraft engaging means mounted to each end of said cable, each said watercraft engaging means on said cable being respectively mounted to said watercrafts to dispose said cable substantially on the vertical longitudinal plane of respective said watercraft.

25. The apparatus as set forth in claim 24 further comprising stabilizing means mounted to and between said stern of said powered watercraft and said stern of said powerless cargo-carrying watercraft for maintaining alignment between said watercrafts.

26. The apparatus as set forth in claim 24 wherein said stabilizing means comprises:

a. a winch mounted to the deck of said powered watercraft rearwardly remote from said thrust transmitting means;

b. a pair of connecting means rigidly mounted to said powerless cargo-carrying watercraft laterally of said retaining means; and c. a pair of elongated cables having a first end engaged by said winch and a second end adapted releasably attached to connecting means of said powerless cargo-carrying watercraft.

27. The apparatus as set forth in claim 1 wherein said powered watercraft is a tug having a ship-shaped bow.

28. The apparatus as set forth in claim 1 wherein said well is defined by a pair of elongated wing walls of a predetermined length to provide a deep recess for stabilization of said watercrafts, said adjustable coupling means being mounted between said powerless watercraft stern and said powered watercraft bow.

29. The apparatus as set forth in claim 1 wherein said well is defined by a pair of short wing walls of a predetermined length to provide a shallow recess, said adjustable coupling means being mounted between said watercraft sterns.

30. The apparatus as set forth in claim 1 further comprising lubricating means for providing lubrication between said transmitting means and said retaining means.

31. The apparatus as set forth in claim 30 wherein said lubricating means includes water spray nozzle means.

32. An apparatus for thrust transmittal from a powered watercraft, said powered watercraft having a forward section terminated by a bow and having an aft section terminated by a stern, to a powerless cargo-carrying watercraft having an aft section terminated by a stern bifurcated so as to form a recessed well therein comprising:

a. an elongated thrust transmitting means horizontally mounted to said bow of said powered watercraft;

b. complementary retaining means mounted centrally of, and within, said well and to said stern of said powerless cargo-carrying watercraft; and c. adjustable coupling means mounted between said powered watercraft and said powerless cargo-carrying watercraft for forcibly holding said thrust transmitting means in retaining contact with said complementary retaining means;

so constructed and arranged that a horizontal pivotal axis substantially transverse to the length of said two watercraft is established between said watercraft, lubricating means for providing lubrication between said transmitting means and said retaining means, said lubricating means including water spray nozzle means, said nozzle means including nozzles disposed above and below said apparatus.

33. The apparatus as set forth in claim 32 wherein said lubricating means is disposed on said powered watercraft.

34. The apparatus as set forth in claim 32 wherein said lubricating means is disposed on said powerless watercraft.

35. An apparatus for thrust transmittal from a powered watercraft, said powered watercraft having a forward section terminated by a bow and having an aft section terminated by a stern, to a powerless cargo-carrying watercraft, said powerless watercraft having an aft section terminated by a bifurcated stern having a recessed well defined by and between said bifurcations, said apparatus comprising:

a. an elongated and resilient substantially semi-cylindrical thrust transmitting means mounted to said bow of said powered watercraft and having an elongated axis extending generally normal to the longitudinal axes of said watercrafts, said thrust transmitting means having a curved exterior surface facing outwardly away from said bow, said curved surface having a plurality of substantially parallel channels extending along the length of each of said elongated thrust transmitting means, each of said channels terminating inwardly adjacent the ends of said thrust transmitting means;

b. an elongated and rigid retaining means mounted centrally of and within said well substantially parallel with said axis of said thrust transmitting means, said retaining means having a length and a curved rewardly facing exterior surface adapted to retainingly accept said thrust transmitting means therewithin; and c. a pair of adjustable length securing means respectively terminating in a pair of releasable watercraft engaging means, and a pair of constant tension devices respectively connected intermediate of said pair of watercraft engaging means, said securing means being spaced apart and connected between said watercrafts to forcibly bias said thrust transmitting means in surface contact with said retaining means.

36. The apparatus as defined in claim 35 further comprising:

d. a winch means mounted to the deck of said powered watercraft at a point thereon rearwardly remote from said thrust transmitting means; and e. a pair of cables respectively having a first end adapted to releasably connect to said powerless cargo-carrying watercraft and a second end attached to said winch means.

37. The apparatus as defined in claim 35 wherein said thrust transmitting means include a pair of elongated and parallel bumpers.

38. The apparatus as defined in claim 37 wherein said retaining means includes a pair of elongated sockets to receive respective said bumpers.

39. The apparatus as defined in claim 35 wherein said plurality of elongated sockets which are located along said stern to permit connection between said powered watercraft and a loaded or unloaded powerless watercraft.

40. The apparatus as set forth in claim 39 further comprising a pair of parallel, vertically upright rigid shafts rigidly mounted to said well on respective sides of said retaining means, each said shaft having a plurality of spaced stops providing spaces therebetween generally horizontally parallel to individual said sockets, for releasably receiving said watercraft engaging means of said securing lines therein and connecting said engaging means to respective said shafts.

41. The apparatus as set forth in claim 35 wherein said curved surface of said thrust transmitting means is convex and wherein said curved surface of said retaining means is concave.

42. The apparatus as set forth in claim 35 further comprising a plurality of resilient bumpers mounted to the rearwardly extending sides of said bow of said powered watercraft such that impact between said bow and said bifurcated stern of said powerless cargo-carrying watercraft are cushioned to avoid damage therebetween.

43. The apparatus as defined in claim 35 wherein said transmitting means is hollow, and provides a lubricating reservoir for lubrication between said transmitting means and said retaining means.

44. The apparatus as defined in claim 43 further comprising passageways between said reservoir and said curved surface.

45. The apparatus as defined in claim 44 wherein said passageways open into said channels.

46. The apparatus as defined in claim 35 further comprising lubricating means for providing lubrication between said thrust transmitting means and said retaining means.

47. The apparatus as defined in claim 35 wherein said well is defined by a pair of short wing walls, said adjustable length securing means being connected between the stern of said powerless watercraft and said powered watercraft bow.

48. The apparatus as defined in claim 35 wherein said well is defined by a pair of elongated wing walls, said adjustable length securing means being connected between the stern of said powerless watercraft and said stern of said powered watercraft.

49. The apparatus as defined in claim 35 wherein said adjustable length securing means includes bow means connected between said powered watercraft bow and the stern of said powerless watercraft and stern means connected between said powered watercraft stern and said powerless watercraft bow.

50. The apparatus as defined in claim 35 wherein said powered watercraft is a tug having a ship shaped bow.

51. An apparatus for thrust transmittal from a powered watercraft, said powered watercraft having a forward section terminated by a bow and having an aft section terminated by a stern, to a powerless cargo-carrying watercraft, said powerless watercraft having an aft section terminated by a bifurcated stern having a recessed well defined by and between said bifurcations, said apparatus comprising:

a. an elongated, resilient, substantially semi-cylindrical thrust transmitting means having a longitudinal axis disposed horizontally and prependicularly to the longitudinal axes of said watercrafts and being mounted to said bow of said powered watercraft, said thrust transmitting means having a substantially curved surface facing outwardly from said bow;

b. a plurality of elongated, rigid retaining means mounted generally centrally of and to said well in parallel vertically superposed relation, each of said retaining means having a length and a curved rearwardly facing surface adapted to retainingly accept said curved surface of said thrust transmitting means therewithin;

c. a pair of adjustable length securing means respectively terminating in a pair of releasable watercraft engaging means for connection between said watercrafts to forcibly bias said thrust transmitting means in movable surface contact with one of said retaining means.

52. The apparatus as defined in claim 51 wherein said curved surface of said thrust transmitting means is convex and wherein said curved surface of each of said retaining means is concave.

53. The apparatus as defined in claim 51 further comprising a pair of parallel, vertically upright rigid shafts rigidly mounted to said well on respective sides of said retaining means, each said shaft having a plurality of spaced stops providing spaces therebetween generally horizontally parallel to individual said retaining means for releasably mounting said watercraft engaging means of said securing lines therein and respectively connecting said engaging means to said shafts.

54. The apparatus as defined in claim 53 wherein said stops are mounted to the stern of said powerless watercraft and support said shafts.

* * * * *